US005328043A

United States Patent [19]

Ray

[11] Patent Number: 5,328,043

[45] Date of Patent: Jul. 12, 1994

[54] BABY BOTTLE WITH SEALING DISK HOLDER

[76] Inventor: Sharon Ray, 4617 Olympia, Mesquite, Tex. 75150

[21] Appl. No.: 109,696

[22] Filed: Aug. 20, 1993

Related U.S. Application Data

[63] Continuation of Ser. No. 795,767, Nov. 21, 1991, abandoned.

[51] Int. Cl.[5] ..... A61J 9/08; B65D 23/12

[52] U.S. Cl. ..... 215/6; 215/11.1; 215/100 R; 220/379; 220/744

[58] Field of Search ..... 215/11.1, 11.6, 6, 100 R, 215/10; 220/379, 744

[56] References Cited

U.S. PATENT DOCUMENTS

| | | | |
|---|---|---|---|
| 1,649,580 | 11/1927 | Geisler . | |
| 1,810,630 | 6/1931 | Tapp | 215/100 R |
| 2,745,301 | 5/1956 | Grunwald | 215/100 R |
| 2,760,665 | 8/1956 | Zenker | 215/11.1 |
| 2,796,188 | 6/1957 | Kurkjian | 215/11.1 |
| 3,355,047 | 11/1967 | De Sole | 215/11.1 |
| 3,402,844 | 9/1968 | Chin | 215/100.5 |
| 3,613,761 | 10/1971 | Moody | 215/11.6 |
| 3,822,806 | 7/1974 | Grimes | 215/11.3 |
| 4,010,861 | 3/1977 | Welten | 215/11.5 |
| 4,040,538 | 8/1977 | Gerson | 220/379 X |
| 4,526,274 | 7/1985 | Kesselring et al. | 215/11.6 X |
| 4,533,057 | 8/1985 | Klittick | 215/11.6 |
| 4,600,111 | 7/1986 | Brown | 215/11.1 X |
| 4,603,784 | 8/1986 | Chang | 215/11.1 |
| 4,796,767 | 1/1989 | McKeown | 215/11.1 |
| 4,815,615 | 3/1989 | Phlaphongphanich | 215/11.1 |
| 4,872,597 | 10/1989 | Hanafusa | 220/379 X |
| 4,940,151 | 7/1990 | Fett | 215/11.1 |
| 5,020,680 | 6/1991 | Bale | 215/11.6 |
| 5,129,520 | 7/1992 | Gaspar | 215/6 X |
| 5,165,546 | 11/1992 | Jaeger et al. | 215/6 X |

FOREIGN PATENT DOCUMENTS

| | | | |
|---|---|---|---|
| 704752 | 3/1965 | Canada | 215/11.6 |
| 1150963 | 8/1957 | France | 215/100 R |
| 67415 | 3/1958 | France | 215/11.1 |
| 259040 | 10/1926 | United Kingdom | 215/10 |

*Primary Examiner*—Sue A. Weaver
*Attorney, Agent, or Firm*—Warren B. Kice

[57] ABSTRACT

This invention relates generally to the field of baby bottles having disks for sealing the apertures of the baby bottles when the bottles are not in use. More specifically, this invention relates to a particular baby bottle that provides a slot at the base of the baby bottle for temporarily storing a sealing disk.

10 Claims, 1 Drawing Sheet

BABY BOTTLE WITH SEALING DISK HOLDER

This is a continuation of co-pending application Ser. No. 07/795,767 filed on Nov. 21, 1991, now abandoned.

FIELD OF THE INVENTION

This invention relates generally to baby bottles having disks for sealing the apertures of the baby bottles when the bottles are not in use. More specifically, this invention relates to a baby bottle that provides a slot or pocket at the base of the baby bottle for temporarily storing a sealing disk.

BACKGROUND OF THE INVENTION

Baby bottles are containers for holding liquids, such as infant formula, milk, juice and the like, that allow liquid to flow out of the bottle and into an infant's mouth without spillage of the bottle contents. Such prevention of spillage is accomplished through the use of a rubberized nipple that is placed over the mouth of the bottle, and sealed to the mouth of the bottle by a retaining ring. The rubberized nipple contains a hole, or a plurality of holes, that allows liquid contained in the bottle to pass through the nipple and into a baby's mouth. An internally threaded retaining ring engages an externally threaded mouth portion of the bottle to seal the nipple over the mouth of the bottle. Thus, liquids contained in the bottle flow through the nipple in a restricted fashion, rather than flowing freely through the mouth of the bottle. When in use, the nipple is placed into an infant's mouth, and the contents of the bottle flow through the nipple. When not in use, a threaded cap or stopper can be placed over the mouth of the bottle to protect the contents from spills, evaporation, or contamination from foreign substances.

In most baby bottles sold today, rather than including a stopper or cap along with the retaining ring and nipple, a manufacturer provides a sealing disk that allows a user to seal the contents of the baby bottle with the retaining ring. A sealing disk is a radial disk that is placed between the nipple and the retaining ring to prevent spillage of the bottle's contents. When a baby bottle is not being used to feed an infant, the nipple is inverted, i.e., rotated to face the baby bottle and placed on the mouth of the baby bottle after which the sealing disk is placed on top of the nipple and the retaining ring is secured to the mouth of the bottle thereby securing the nipple and the sealing disk to the mouth of the bottle. When used in this fashion, the sealing disk prevents any liquids contained in the bottle that would otherwise flow through the nipple from escaping from the bottle. The sealing disk has thus provided an inexpensive way to seal a baby bottle without requiring the manufacture to provide both a retaining ring and a stopper or cap.

A problem occurs however when the sealing disk is removed from the bottle so that the bottle can be used to feed an infant. When the sealing disk is removed from the bottle, the nipple is inverted so as to face the infant and the retaining ring is placed over the mouth of the bottle to seal the nipple to the mouth of the bottle. This allows the liquid contained in the bottle to pass through the nipple and to the infant. However, as is often the case, when the bottle is in use, the sealing disk is misplaced, lost or thrown away. With no mechanism remaining to re-seal the bottle, the contents of the bottle spill out through the holes in the nipple when the bottle is not is use.

SUMMARY OF THE INVENTION

It is an object of the present invention to provide a way to store a baby bottle sealing disk at the base of the baby bottle so that the sealing disk will not be misplaced while the baby bottle is in use.

It is another object of the present invention to provide a prefabricated slot or strip at the base of the baby bottle to store the sealing disk when it is removed from the mouth of the bottle, i.e., to allow the infant to feed.

It is a further object of the present invention to allow the sealing disk to be removed from the slot or strip at the base of the baby bottle and replaced on the mouth of the bottle, to prevent spillage, when the infant is finished feeding.

The above objects are met and a technical advantage is achieved in a preferred embodiment of a baby bottle including a bottle for holding liquids, a sealing disk for sealing the liquids in the bottle, and a slot or strip at one end of the bottle for storing the sealing disk when the bottle is in use.

BRIEF DESCRIPTION OF THE DRAWINGS

The novel features believed characteristic of the present invention are set forth in the appended claims. The invention itself, however, as well as other objects, features and advantages, will be best understood by reference to the following detailed description of an illustrative embodiment when read in conjunction with the accompanying figures, wherein:

DETAILED DESCRIPTION OF THE INVENTION

Figure 1:
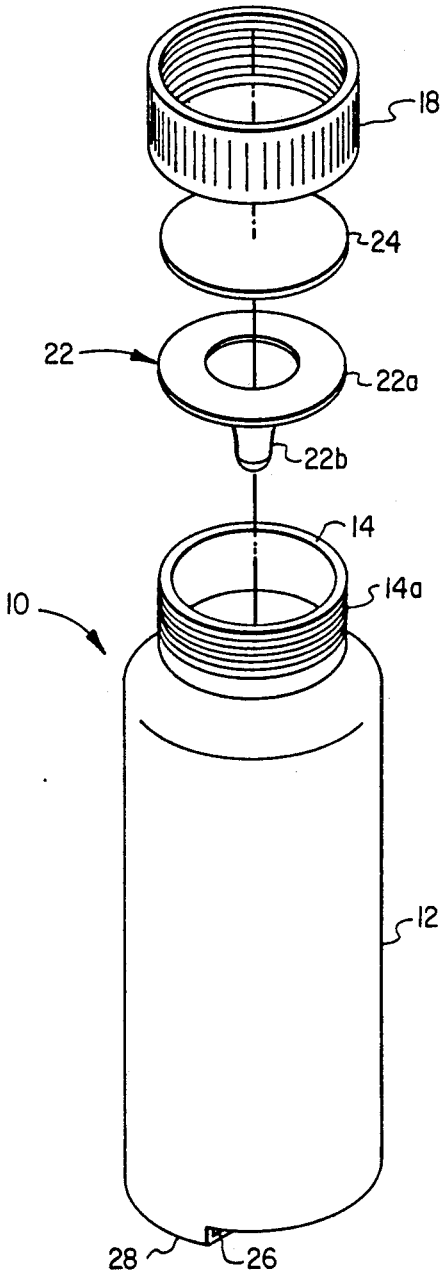
FIG. 1 is a view of a baby bottle pertaining to the present invention.

Referring to FIG. 1 of the drawings, the baby bottle of the present invention is shown in general by the reference numeral 10 and comprises a container 12 with a cylindrical mouth 14 whose outer surface 14*a* is threaded for connection to an internally threaded retaining cap 18. Between the retaining cap 18 and the container 12 is disposed a nipple 22 and a sealing disk 24.

The container 12 is an elongated tube that is sealed at one end and open at the other and is manufactured so as to hold liquids such as infant formula, milk, juice and the like. The mouth 14 is found at the open end of the container and allows liquids to flow into and out of the container 12.

The threaded outer surface 14*a* of the mouth 14 is used with the retaining cap 18 to secure one of a plurality of devices to the mouth 14. Such devices control the manner of liquid flow into and out of the container 12. One device that is well known in the art is a nipple 22. The nipple 22 is a soft rubberized apparatus with a flange 22*a* at one end for sealing the nipple to the mouth 14, and a protrusion 22*b* at the other end with a small hole or plurality of holes to allow liquid to flow through the protrusion.

Figure 2:
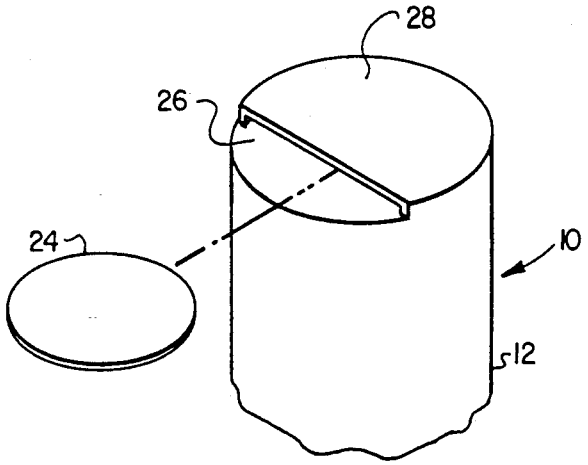
FIG. 2 is a view of the bottom of the baby bottle pertaining to the present invention.

As shown in FIG. 2, a slot or pocket 26 is formed in the base of the container 12 to provide an enclosure to securely hold the sealing disk 24 when the sealing disk 24 is not being used to seal the mouth 14 of the container 12. The slot 26 is formed in the base of the container 12 by extending a portion of the wall of the container past the base of the container, and adding a second base 28 on top of the extended portion. The extended wall portion is carefully sized to allow just enough space for the insertion of the sealing disk 24 between the base of the container 12 and the second base 28 yet enable the disk to be retained in place by friction.

When the bottle 10 is in use, liquid is placed into the container 12 through the mouth 14, the nipple 22 is placed on top of the mouth 14 so that the protrusion **22*b* faces away from the container 12, and the retaining cap 18 is screwed onto the threaded outer perimeter 14*a* so as to secure the nipple 22 to the mouth 14 of the container 12. When configured in this fashion, the liquid placed in the container 12 flows, in a restricted fashion, through the nipple 22**.

When the bottle 10 is not in use, the nipple 22 is inverted so that the protrusion **22*b* faces the container 12 as shown in FIG. 1. The sealing disk 24 is placed on top of the nipple 22, and both are secured to the container 12 by the retaining cap 18 so that the protrusion 22*b* of the nipple 22 extends down into the mouth 14. The sealing disk 24 is a rigid material, such as plastic, whose radius is greater than the radius of the protrusion 22*b* of the nipple 22. When placed on top of the nipple 22, and secured to the container 12 by the retaining cap 18, the sealing disk 24 prevents any liquid in the container 12 from flowing out of the mouth 14 and through the nipple 22. In this fashion, leaks and spills from the container 12** are prevented.

When the bottle 10 is to be used to feed an infant, the retaining cap 18 is Unscrewed from the threaded outer surface 16 of the mouth 14, the sealing disk 24 is removed, the nipple 22 is inverted so that the protrusion faces away from the container 12, and the nipple 22 is secured to the container 12 by means of the retaining cap 18. At this time, since the sealing disk 24 is not needed, it is placed in the slot 26 at the base end of the container 12 as shown in FIG. 2.

Figure 3:
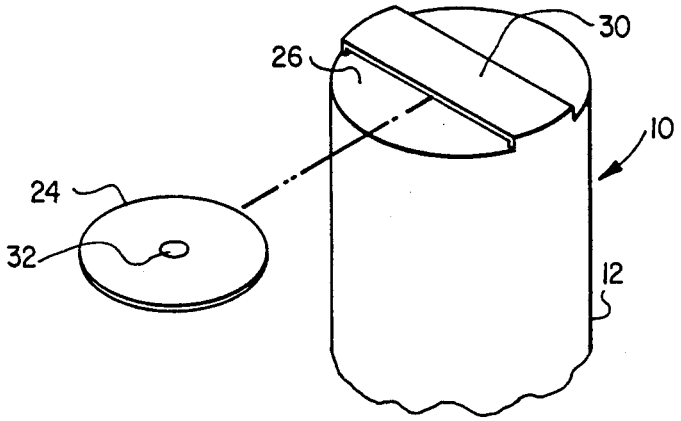
FIG. 3 is a view of the bottom of the baby bottle pertaining to an alternative embodiment of the present invention.

Referring to FIG. 3, an alternative embodiment of the present invention is shown wherein a strip 30 is placed across the bottom of the baby bottle 12 for securing the sealing disk 24 between the strip 30 and the bottom of the bottle 12 when the sealing disk 24 is not in use. In this embodiment, the bottom of the baby bottle 12 is manufactured in a concave fashion so that the bottom of the bottle 12 extends towards the inside of the bottle 12. When the bottom of the bottle 12 is concave, the strip 30 extends between the side walls of the bottle 12, so that the strip 30 is flush with the bottom portion of the side walls. The area between the strip 30 and the bottom of the bottle 12 is carefully sized to allow just enough space for the insertion of the sealing disk 24 between the base of the container 12 and the strip 30 yet enable the disk to be retained in place by friction.

In another embodiment of the present invention, a small raised protrusion 32 is manufactured on one side of the sealing disk 24. An inverse of the protrusion 32 is molded into the inside surface of the strip 30 for engaging with the protrusion 32 thereby locking the sealing disk 24 to the bottom of the bottle 12 when the sealing disk is not in use.

Although illustrative embodiments of the present invention have been shown and described, a latitude of modification, change and substitution is intended in the foregoing disclosure, and in certain instances some features of the invention will be employed without a corresponding use of other features. Accordingly, it is appropriate that the appended claims be construed broadly and in a manner consistent with the scope of the invention.

What is claimed is:

1. A bottle comprising:

a hollow cylinder;

a mouth formed at one end of said cylinder for permitting the ingress and egress of liquids into and from said cylinder, respectively, and for receiving sealing means for preventing said ingress and egress when said bottle is not in use;

a first base member disposed at the other end of said cylinder to close off said other end to permit said liquid to be contained in said cylinder, an arcuate portion of said cylinder extending beyond said base member; and an additional base member rigidly fixed to and encompassing said extended, arcuate cylinder portion and said first base member a housing of sufficient size to removably receive said sealing means in a friction fit to retain and store said sealing means.

2. The bottle of claim 1 wherein said sealing means is a disk having a diameter sufficient to cover said mouth.

3. The bottle of claim 2 wherein the height of said housing is just greater than the thickness of said disk to establish said friction fit.

4. The bottle of claim 3 wherein the planer dimension of said disk is greater than that of said additional base member so that, when said disk is received in said housing, a portion of said disk extends in said housing and a portion extends out of said housing to enable said latter portion to be grasped to remove said disk from said housing.

5. A bottle comprising:

a hollow cylinder;

a mouth formed at one end of said cylinder for permitting the ingress and egress of liquids into and from said cylinder, respectively, and for receiving a disk having a diameter sufficient to cover said mouth for preventing said ingress and egress when said bottle is not in use;

a base member disposed at the other end of said cylinder to close off said other end to permit said liquid to be contained in said cylinder; and a bracket member rigidly fixed to and extending between opposing walls of said cylinder to define with said base member a slot the height of which is just greater than the thickness of said disk to removably receive said disk in a friction fit to retain and store said disk.

6. The bottle of claim 5 wherein the planer dimension of said disk is greater than that of said bracket member so that, when said disk is received in said slot, a portion of said disk extends in said slot and a portion extends out of said slot to enable said latter portion to be grasped to remove said disk from said slot.

7. The bottle of claim 5 wherein one planar surface of said disk includes a protrusion for engaging said bracket member so that, when said disk is received in said slot, said disk is retained in said slot by friction.

8. A bottle comprising:

a hollow cylinder;

a mouth formed at one end of said cylinder for permitting the ingress and egress of liquids into and from said cylinder, respectively, and for receiving sealing means for preventing said ingress and egress when said bottle is not in use;

a first base member disposed at the other end of said cylinder to close off said other end to permit said liquid to be contained in said cylinder, an arcuate portion of said cylinder extending beyond said base member; and an additional base member rigidly fixed to and encompassing said extended, arcuate cylinder portion to define with said extended, arcuate cylinder portion and said first base member a partially enclosed housing sized in a manner to removably receive a portion of said sealing means for retention and storage while the remaining portion of said sealing means is exposed to enable said remaining portion to be grasped to remove said sealing means from said housing.

9. The bottle of claim 8 wherein said sealing means is a disk having a diameter sufficient to cover said mouth.

10. The bottle of claim 9 wherein the height of said housing is just greater than the thickness of said disk such that said disk is retained in said housing by friction.

* * * * *